US005759078A

United States Patent [19]

Levine et al.

[11] Patent Number: 5,759,078

[45] Date of Patent: Jun. 2, 1998

[54] FIELD EMISSION DEVICE WITH CLOSE-PACKED MICROTIP ARRAY

[75] Inventors: Jules D. Levine, Dallas; Kenneth G. Vickers, Whitesboro; Robert H. Taylor, Richardson, all of Tex.

[73] Assignee: Texas Instruments Incorporated, Dallas, Tex.

[21] Appl. No.: 686,427

[22] Filed: Jul. 26, 1996

Related U.S. Application Data

[63] Continuation of Ser. No. 453,300, May 30, 1995, abandoned.

[51] Int. Cl.[6] ..... H01J 29/70

[52] U.S. Cl. ..... 445/24; 313/309; 445/50

[58] Field of Search ..... 445/24, 50; 313/309, 313/336

[56] References Cited

U.S. PATENT DOCUMENTS

| | | | |
|---|---|---|---|
| 3,453,478 | 7/1969 | Shoulders et al. . | |
| 3,745,402 | 7/1973 | Shelton et al. . | |
| 3,755,704 | 8/1973 | Spindt et al. . | |
| 3,795,838 | 3/1974 | Hill . | |
| 3,812,559 | 5/1974 | Spindt et al. . | |
| 3,814,968 | 6/1974 | Nathanson et al. . | |
| 3,852,595 | 12/1974 | Aberth . | |
| 4,818,914 | 4/1989 | Brodie . | |
| 4,857,161 | 8/1989 | Borel et al. . | |
| 4,940,916 | 7/1990 | Borel et al. . | |
| 5,063,323 | 11/1991 | Longo et al. | 313/309 |
| 5,194,780 | 3/1993 | Meyer . | |
| 5,225,820 | 7/1993 | Clerc . | |
| 5,404,070 | 4/1995 | Tsai et al. | 313/309 X |
| 5,514,847 | 5/1996 | Makishima et al. . | |
| 5,534,744 | 7/1996 | Leroux et al. . | |
| 5,541,466 | 7/1996 | Taylor et al. | 313/309 X |

FOREIGN PATENT DOCUMENTS

| | | |
|---|---|---|
| 2687839 | 8/1993 | France . |

*Primary Examiner*—Kenneth J. Ramsey

*Attorney, Agent, or Firm*—Warren L. Franz; Wade James Brady, III; Richard L. Donaldson

[57] ABSTRACT

An electron emitter plate (110) for an FED image display has an extraction (gate) electrode (22) spaced by an insulating layer (125) from a cathode electrode including a conductive mesh (18). Hexagonal close-packed arrays (12) of microtips (14) are located in mesh spacings (16), within apertures (26) formed in extraction electrode (22). Microtips (14) are formed on a conductive plate (17) laterally spaced from mesh structure (18) by a resistive layer (15). Insulating layer (125) is etched to connect apertures (26) and place microtips (14) in a common cavity within each mesh spacing (16).

16 Claims, 7 Drawing Sheets

FIELD EMISSION DEVICE WITH CLOSE-PACKED MICROTIP ARRAY

This application is a continuation of application Ser. No. 08/453,300, filed May 30, 1995, abandoned.

TECHNICAL FIELD OF THE INVENTION

The present invention relates generally to electron emitting structures of the field emission type; and, in particular, to improved microtip emission cathode structures and FED field emission flat-panel image display devices utilizing such structures.

BACKGROUND OF THE INVENTION

Examples of conventional electron emitting devices of the type to which the present invention relates are disclosed in U.S. Pat. Nos. 3,755,704; 3,812,559; 4,857,161; 4,940,916; 5,194,780 and 5,225,820. The disclosures of those patents are incorporated herein by reference.

Microtip emission cathode structures usable in FED field emission flat-panel image display devices, as described in the referenced patents, typically comprise thin film metal/insulator/metal sandwich structures deposited on a glass or silicon support substrate. In a usual self-aligning method of fabrication, first and second conductive layers are deposited on the substrate, separated by an intervening dielectric insulating layer which functions to space and insulate the conductive layers. The bottom conductive layer functions as the emitting or cathode electrode. The top conductive layer functions as the extractor or gate electrode. Apertures are formed in the top conducting layer and in the intervening dielectric material, and a microtip emitter (sometimes called an electron field emitting spike, needle or protuberance) is formed within each aperture in electrical communication with the bottom conductive layer. Traditional designs have placed the emitters in either random or rectangular matrix arrays.

Early implementations formed the microtips directly on the lower or cathode electrode. Such arrangement, however, provided little protection against excessive current draw. The use of a resistive layer was therefore proposed to provide a ballast against excessive current in each microtip emitter, and consequently to homogenize the electron emission. The Borel, et al. '916 patent describes the use of a resistive layer above the cathode electrode and beneath the microtips. Such vertical resistor approach helps eliminate nonuniformity caused by excessively bright spots and reduces breakdown risk at the microtips by limiting current flow when local short-circuiting occurs between individual microtips and the gate. Under the Borel approach, however, when a short circuit occurs between a microtip and the gate, the full voltage applied between the gate and cathode conductors is applied vertically across the resistive coating. This requires the resistive coating to be thick enough to withstand the gate-to-cathode without breaking down due to heat. Thus, the existence of "pinhole" or other defects which locally reduce the thickness will lead to breakdown.

The Meyer '780 patent overcomes this deficiency by use of a lateral resistor cathode structure for a field emission device. A plurality of arrays of electrically conductive microtips are formed on a resistive layer, within respective mesh spacings of a conductive layer which is patterned into a mesh structure configuration. This arrangement provides an improvement in breakdown resistance of a field effective emissive device, without requiring increasing the thickness of the resistive layer. The mesh-like structure of the cathode conductor (and/or the gate conductor), permits the cathode conductors and the resistive coating of the Meyer patent to lie substantially in the same plane. In such configuration, the breakdown resistance is no longer susceptible to defects in the vertical thickness of the resistive coating. It is the lateral separation of the microtips from the cathode conductor by the resistive coating which provides the ballast against excessive current. It is therefore, sufficient to maintain a horizontal distance between the cathode conductor and the microtip which is adequate to prevent breakdown, while still retaining a homogenization affect for which the resistive coating is supplied.

In both the '916 and '780 approaches each microtip is positioned atop a resistive layer. In the Borel, et al. '916 patent, it is the thickness, or vertical dimension, of the resistive layer that provides a ballast against excessive currents; in the Meyer '780 patent, it is the lateral spacing, or horizontal dimension, that provides the ballast. The ballast is in the form of a resistive voltage drop, such that those microtips drawing the most current have the greatest resistive drop, thus acting in such a way as to limit microtip current. An equivalent circuit of the '916 or '780 ballast arrangement would have each tip in series with an individual buffer resistor to limit the field emission current. However, the ballast resistance between the microtips and the cathode conductor varies with the position of the individual microtip within the array. The difference in resistive path between the mesh structure and the individual microtips is especially pronounced because of the traditional rectangular groupings provided within the mesh spacings. In a four-by-four rectangular matrix array, for example, a microtip in the corner of the array has a lower ballast resistance than a microtip at the side of the array, and a microtip in either the corner or the side will, in turn, have a lower ballast resistance than a microtip in the interior of the array. The effect of the difference in ballast resistance among microtips becomes even more pronounced as the size of the array or the spacing between microtips increases. There is, therefore, a need for developing microtip emission cathode structures, and displays incorporating such structures, wherein all microtips in the same array are at substantially equal potential. A high density of equal potential microtips is desirable because close proximity of microtips will minimize the differences in resistive paths. Also, a greater concentration of emitters per area of phosphor coating, will result in increased field emission for the same gate-to-cathode voltage difference; thereby increasing the brightness of a particular pixel.

An FED (field emission device) flat-panel image display device of the type described in Meyer U.S. Pat. No. 5,194,780 is shown in FIGS. 1–5. Such device includes an electron emitter plate 10 spaced across a vacuum gap from an anode plate 11 (FIG. 1). Emitter plate 10 comprises a cathode electrode having a plurality of cellular rectangular arrays 12 of n×m electrically conductive microtips 14 formed on a resistive layer 15, within respective mesh spacings 16 (FIG. 2) of a conductive layer mesh structure 18 patterned in stripes 19 (referred to as "columns") (FIG. 5) on an upper surface of an electrically insulating (typically glass) substrate 20 overlaid with a thin silicon dioxide ($SiO_2$) film 21. An extraction (or gate) electrode 22 (FIGS. 1–3) comprises an electrically conductive layer of cross-stripes 24 (referred to as "rows") (FIG. 5) deposited on an insulating dielectric layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in U.S. Pat. No. 3,755,704, wherein apertures 26 and cavities 41 are etched after deposition of layers 22, 25 and wherein a respective microtip 14 is formed within each aperture 26 and cavity 45. The relative parameters of microtips 14, insulating layer 25 and conductive layer 22 are chosen to place the apex of each microtip 14 generally at the level of layer 22 (FIG. 1). Electrode 22 is patterned to form aperture islands or pads 27 centrally of the mesh spacings 16 in the vicinity of microtip arrays 12, and to remove cross-shaped areas 28 (FIG. 3) over the intersecting conductive strips which form the mesh structure of conductor 18. Bridging strips 29 of electrode 22 are left for electrically interconnecting pads 27 of the same row cross-stripe 24.

Anode plate 11 (FIG. 1) comprises an electrically conductive layer of material 31 deposited on a transparent insulating (typically glass) substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a coating of phosphor cathodoluminescent material 34, deposited over the conductive layer 31, so as to be directly facing and immediately adjacent extraction electrode 22.

In accordance with conventional teachings, groupings of the microtip cellular arrays 12 in mesh spacings 16 corresponding to a particular column-row image pixel location can be energized by applying a negative potential to a selected column stripe 19 (FIG. 5) of cathode mesh structure 18 relative to a selected row cross-stripe 24 of extraction electrode 22, via a voltage source 35, thereby inducing an electric field which draws electrons from the associated subpixel pluralities of n×m microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 28, completing the electrical circuit to voltage source 35.

The various column-row intersections of stripes 19 of cathode mesh structure 18 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11. However, even with row-at-a-time addressing, the per pixel addressing duty factor is small. For example, the pixel dwell time (fraction of frame time available to excite each pixel) for row-at-a-time addressing in a 640×480 pixel color display refreshed at 60 frames per second (180 RGB color fields per second), is only about 8–10 microseconds per row. This means that for pulse-width modulated gray scale control, where the dwell time per pixel is further divided into as many as 64 dwell time subintervals, column voltage switching during row "on" times occurs at the rate of about once every 30–40 nanoseconds. At such high switching rates, total gate-to-cathode capacitance for the column stripes 19 becomes a significant factor in the RC time constant and has a predominant adverse influence on the $\frac{1}{2}CV^2$ power consumption factor. Some reduction in capacitance is achieved through the described patterning of gate electrode 22, wherein removal of gate electrode from areas 28 reduces capacitance away from the microtips. There remains, however, a pressing need to reduce the column gate-to-cathode capacitance even more in such field effect devices.

SUMMARY OF THE INVENTION

The invention provides an electron emitting structure of the field emission type having improved microtip packing density. In particular, the invention provides a thin-film microtip emission cathode structure having microtips arrayed in a hexagonal close-packed array. Such close-packing can be used, for example, to place a same number of tips in a smaller area within a mesh spacing, thereby providing closer equalizations of resistive layer distances between the mesh structure and the microtips in a lateral resistance "subpixel mesh" arrangement of the type described in the Meyer '780 patent. Such close-packing can alternatively be used to provide a greater number of pixels in the same area in any kind of electron emitting structure, thereby increasing the amount of field emission for the same gate-to-cathode voltage and, thus, the brightness of a display.

In another aspect of the invention, an electron emitting structure of the field emission type is provided which has reduced cathode-to-gate capacitance. In particular, the invention provides a thin-film microtip emission cathode structure of the metal/insulator/metal sandwich type construction with reduced column cathode-to-gate dielectric constant, achieved through reduction in the mass of the insulating layer that serves to space cathode and gate electrode layers. This is achieved, for example, in a self-aligned microtip fabrication process, wherein a close-packed array of apertures is formed on a gate of a subpixel mesh electron emitting structure of the Meyer type. The close packing enables the ready undercutting of gate apertures in the dielectric layer, to etch away barriers between neighboring microtips formed through the apertures. This places all microtips of a cluster in a common cavity, with the gate conductor supported peripherally of the cavity.

In accordance with yet another aspect of the invention, an electron emission apparatus is provided with a plurality of microtip emitters formed in a close-packed array on a conductive plate which is located within a mesh spacing defined by a conductive mesh structure, laterally spaced from the plate by a resistive layer. Such arrangement provides a high packing density of microtips with substantially equal ballasted resistive paths and, thus, at generally uniform voltage potential. Moreover, forming the microtips on a plate simplifies expanded etching of the insulating layer to remove dielectric material between neighboring microtips, as now the etching is done down to a conductive material (i.e. a metal layer) rather than down to a resistive layer. This expands the choice of resistive materials and/or the choice of etching materials because the importance of selectivity between dielectric and resistive material during etching is no longer is a lesser consideration.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1—1 of FIGS. 2 and 4;

FIG. 2 is a top plan view of a portion of a pixel of the image forming area of the cathode plate of the display;

FIG. 3 is a view of the cathode plate laterally displaced from that of FIG. 1, corresponding to a section taken along the line 3—3 of FIGS. 2 and 4;

FIG. 4 is an enlarged top plan view, with gate electrode layer removed, of a central region of one subpixel mesh spacing of the display; and FIG. 5 is a schematic macroscopic top view of a corner of the cathode plate useful in understanding the row-column, pixel-establishing intersecting relationships between the cathode grid and pad-patterned gate electrodes shown in greater enlargement in FIG. 2.

FIG. 6 is a view, corresponding to that of FIG. 3 (except that the gate electrode layer and mesh structure are shown in FIG. 6), of a display incorporating an electron emitting structure in accordance with the invention;

FIG. 7 is a perspective view, in section (corresponding to a section taken along the line 7—7 of FIG. 6), of the same display as FIG. 6;

FIGS. 8A–8B, 9A–9B and 10A–10B are schematic views helpful in understanding the arrangement and advantages of the close-packed array aspect of the invention; and FIGS. 11A–11F are schematic views showing steps in a method of fabricating the structure of FIGS. 6, 7 and 10A–10B.

Throughout the drawings, like elements are referred to by like numerals.

DETAILED DESCRIPTION OF PREFERRED EMBODIMENTS

Figure 6:
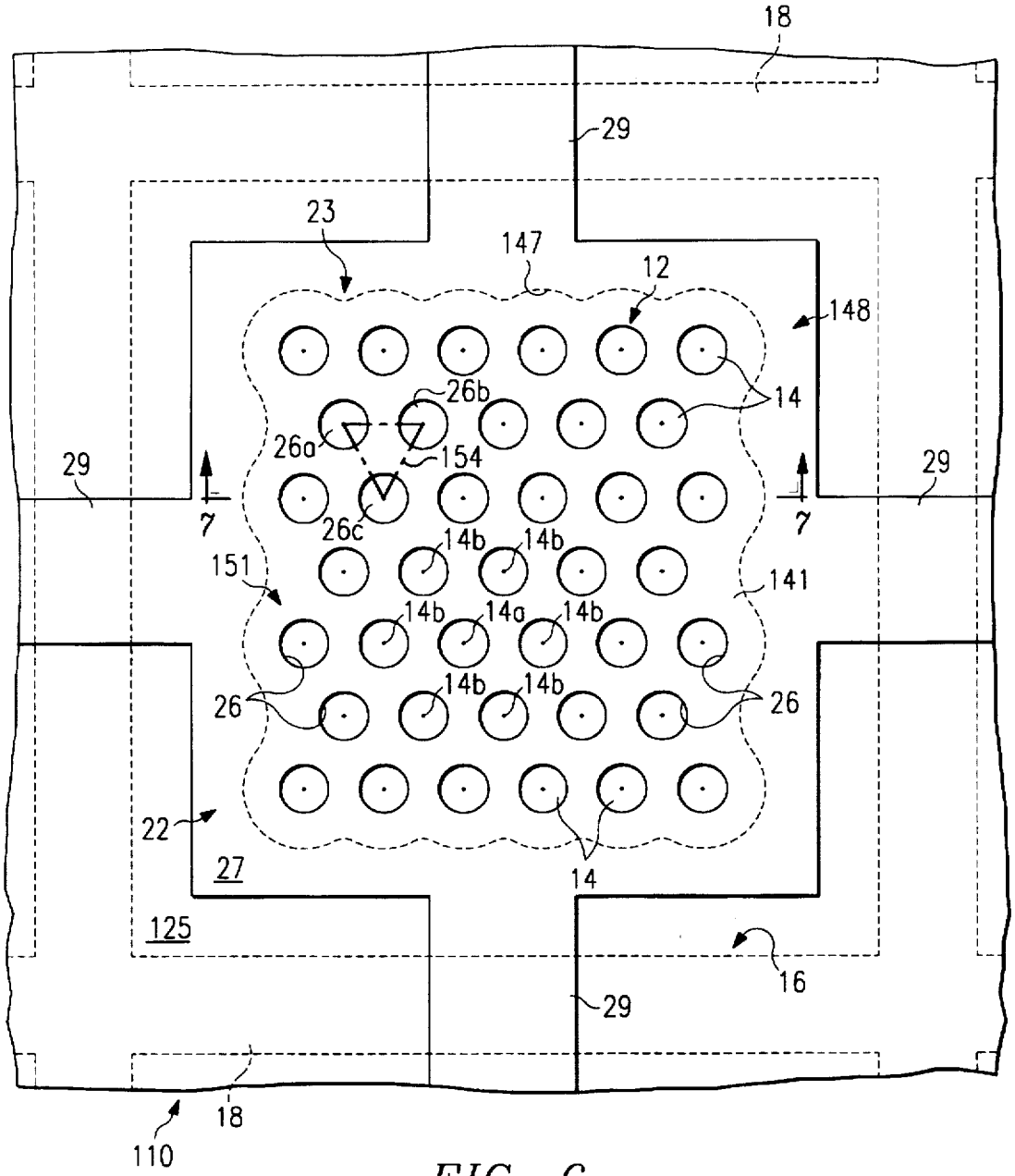
FIGS. 6–7, 8A–8B, 9A–9B, 10A–10B and 11A–11F illustrate embodiments of the invention.
Figure 7:
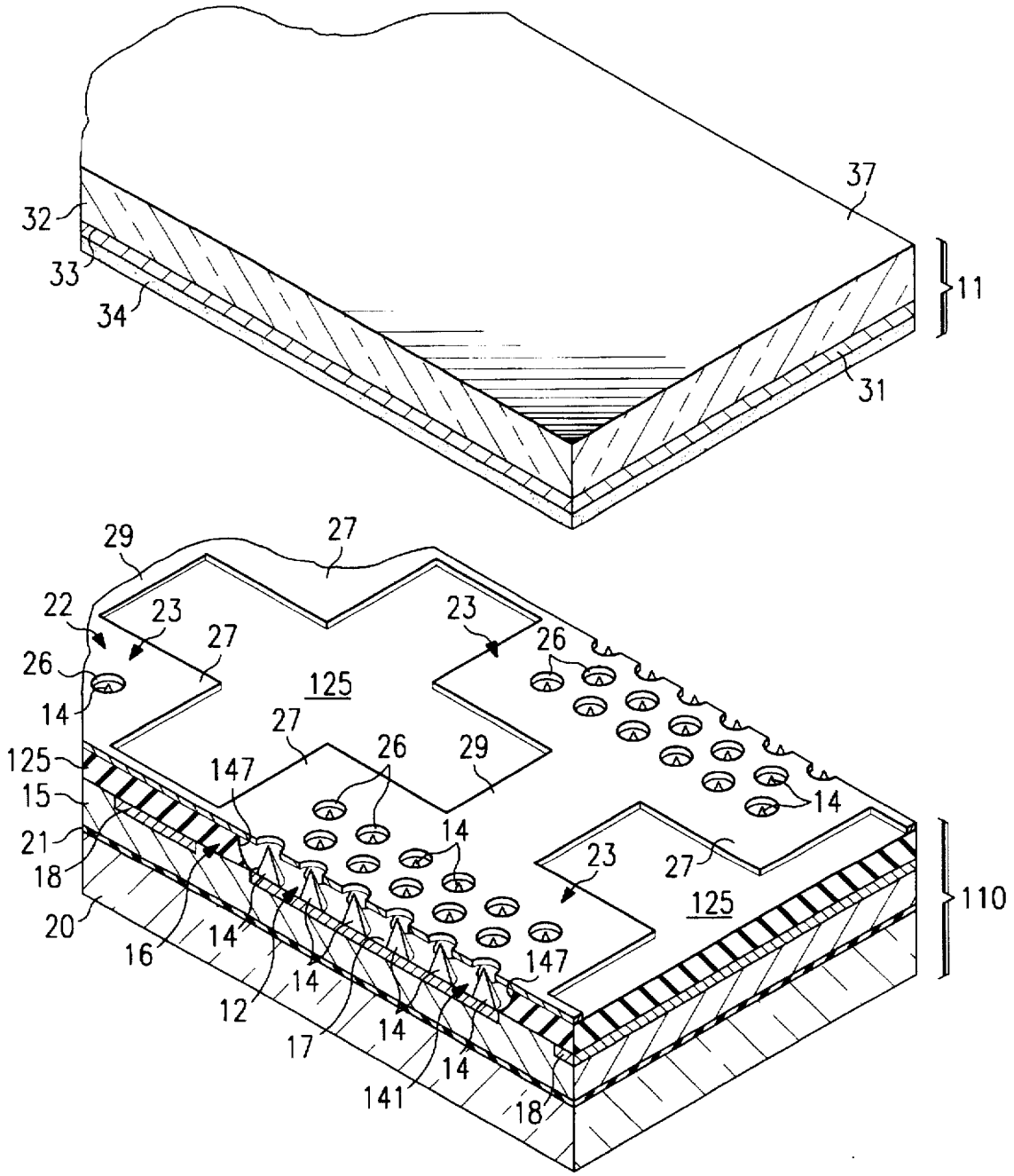

FIGS. 6 and 7 illustrate an embodiment of an FED flat-panel image display device, incorporating an electron emitter plate 110 fabricated in accordance with the teachings of the present invention.

As with the device of FIGS. 1–5, the emitter plate 110 (see FIG. 7) is spaced across a vacuum gap from an anode plate 11, which may be identical to the anode plate 11 previously described. Likewise, in conformance with the previously described emitter plate 10, emitter plate 110 generally comprises a cathode electrode having a plurality of clusters of similar electrically conductive microtips 14, each cluster formed in a cellular array 12 within a respective mesh spacing 16 (see FIGS. 6 and 7) of a conductive layer mesh structure 18 patterned in column stripes 19 (see FIG. 5) on an upper surface of a glass or other substrate 20 overlaid with a thin silicon dioxide ($SiO_2$) film 21. In the illustrated embodiment, tips 14 of each array 12 are formed on a conductive plate 17 located centrally of the mesh spacings 16 on a resistive layer 15 deposited between the conductive layer mesh 18 and the film 21, as shown. Microtips 14 could also be formed directly on resistive layer 15 in accordance with the teachings of the Meyer '780 patent. However, use of a plate 17 is preferred because it functions as a ballast mechanism, as described in U.S. patent application Ser. No. 08/341,829 of Taylor, et al., entitled "Cluster Arrangement of Field Emission Microtips on Ballast Layer," filed Nov. 18, 1994, the disclosure of which is incorporated herein by reference. Likewise, as stated in the '829 application, one or both of the plate 17 and mesh structure 18 can be located below resistive layer 15, if desired.

Also, in conformance with the previously described emitter plate 10, the illustrated emitter plate 110 may have an extraction (or gate) electrode 22, patterned to form aperture islands or pads 27, each having a cluster 23 of apertures 26 arranged in one-to-one correspondence with the microtips 14 and located centrally within a respective cathode electrode mesh spacing 16. The extraction electrode comprises an electrically conductive layer 22 of row-defining cross-stripes 24 (see FIG. 5) that run transversely to the stripes 19 defined by the cathode electrode mesh structure 18.

Figure 1:
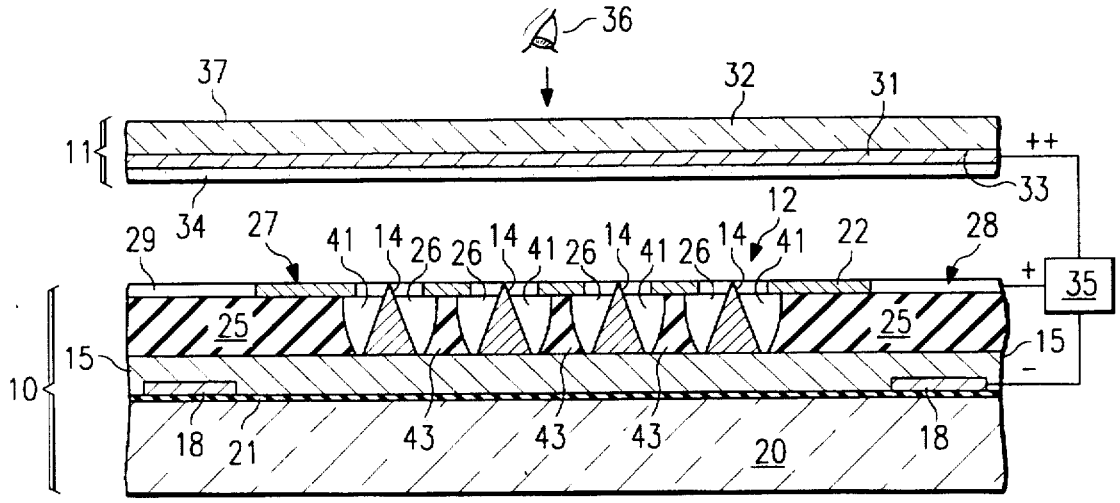
FIG. 1 (PRIOR ART)
FIGS. 1–5, already described and relating to the prior art, illustrate a typical "subpixel mesh" electron emitting structure fabricated utilizing conventional thin-film deposition techniques, and embodied in an FED flat-panel image display device.
Figure 2:
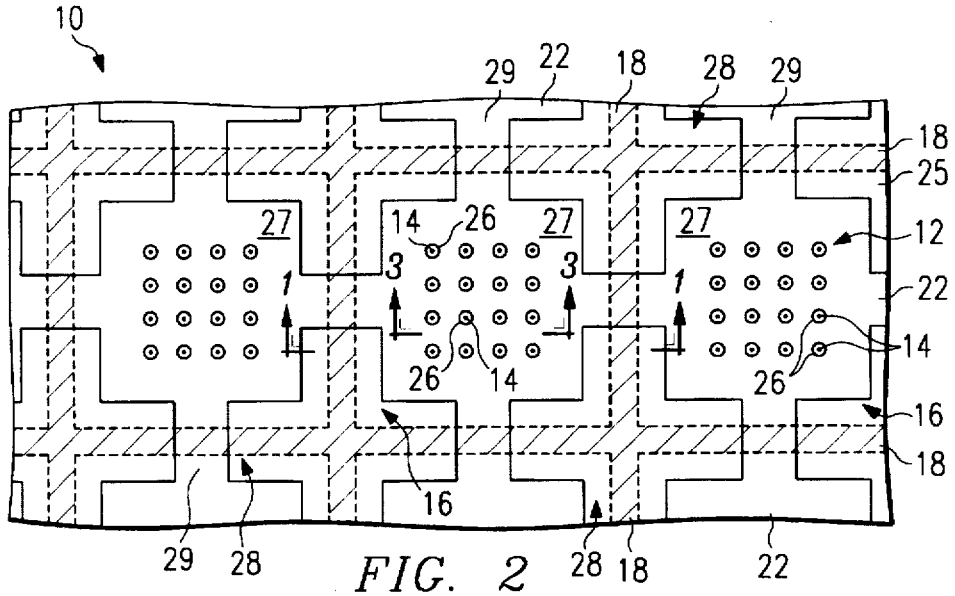
FIG. 2 (PRIOR ART)
Figure 3:
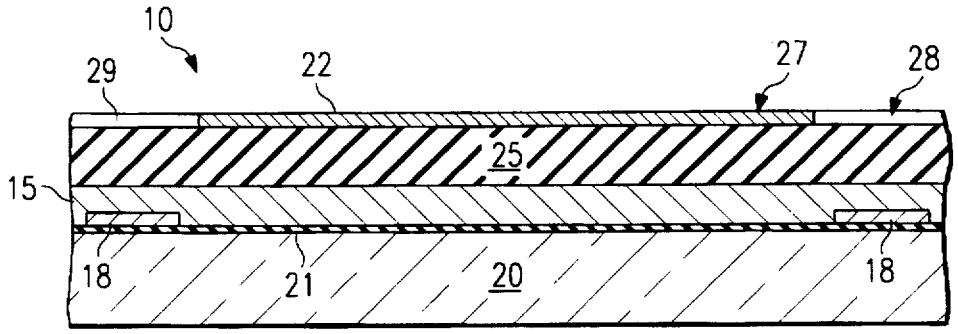
FIG. 3 (PRIOR ART)
Figure 4:
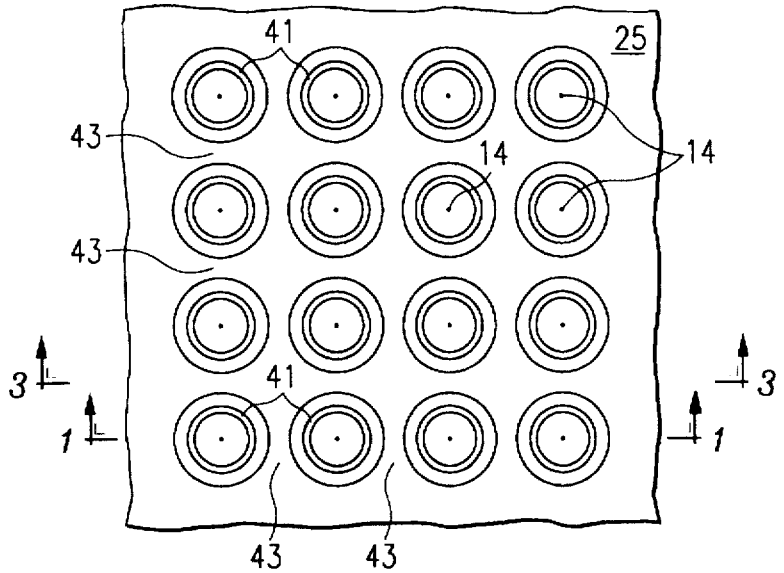
FIG. 4 (PRIOR ART)
Figure 5:
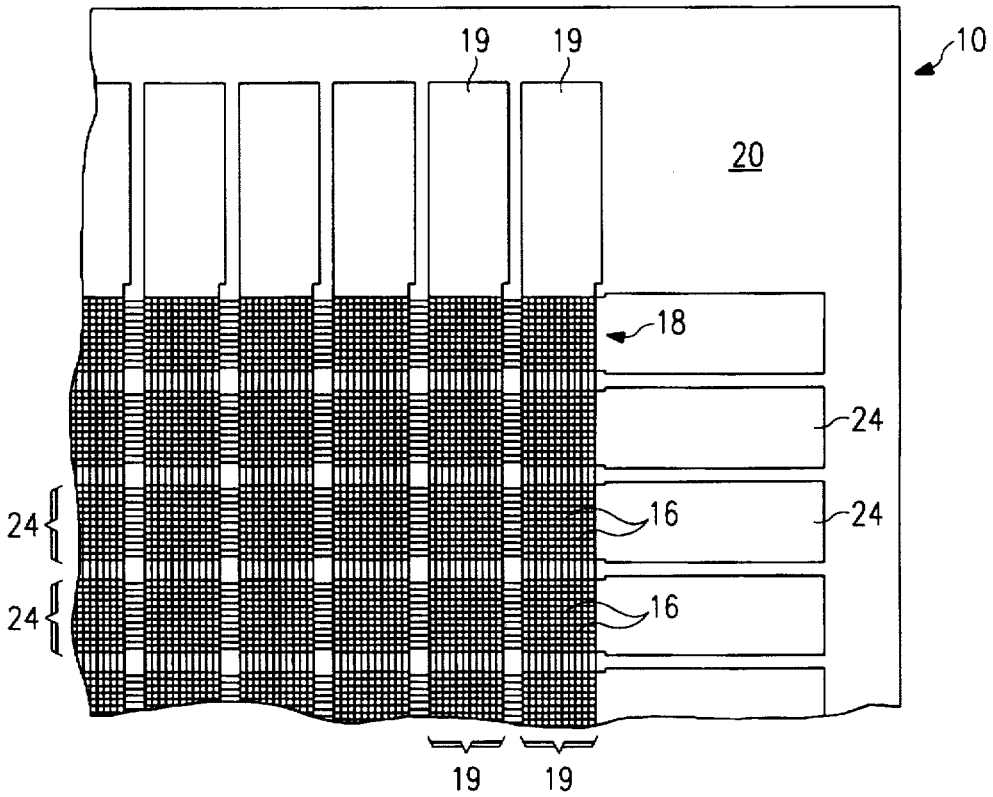
FIG. 5 (PRIOR ART)

Conductive layer 22 is spaced and insulated from resistive layer 15 and cathode mesh structure 18 by an intervening dielectric insulating layer 125 which corresponds to the layer 25 shown in FIGS. 1, 3 and 4. Unlike layer 25, however, layer 125 does not have discrete isolated cavities 41, formed concentrically about the site of each microtip 14, leaving unbroken partitions 43 separating adjacent ones of the cavities 41 of the microtips 14 of the same cluster 12 (see FIGS. 1 and 4). Instead, the mass of insulating layer 125 has been reduced to remove partitions 43 and provide microtips 14 of each cluster 12 commonly located in a shared larger cavity 141 (see FIG. 7).

As shown in FIG. 6 and 7, each cluster 23 of apertures 26 is arranged in a staggered two-dimensional lattice array, having row-adjacent apertures **26*a* and 26*b* (FIG. 6) and column-adjacent apertures 26*a* and 26*c* (FIG. 6) separated by the same generally even spacing. The apertures 26 are thus arranged in a hexagonal close-packed lattice configuration, wherein lines drawn between centers of closest row-adjacent and column-adjacent apertures 26*a*, 26*b*, 26*c* form equilateral triangles 154 (shown in dot-dashed lines in FIG. 6). Likewise, as shown in FIG. 7, the microtips 14 of each microtip cluster 12, which are in one-to-one correspondence with the apertures 26 of each cluster 23, are also arranged in a hexagonal close-packed array, with central microtips 14*a* (see FIG. 6) equiangularly surrounded by six closest neighboring microtips 14*b***.

The reduction in mass of material 125 centrally of the mesh spacing 16 (see FIGS. 6 and 7) positions the microtips 14 of each array 12 within a single, common main cavity 141 (area bounded by dashed lines in FIG. 6) formed centrally within each mesh spacing 16. The gate electrode layer 22 is supported peripherally, marginally of each pad 27 on insulating material 125 (see FIG. 6) bordering the perimeter of cavity 141, on a boundary wall 147 (dashed lines in FIG. 6) defining the lateral extremities of cavity 141 of each array 12. The portion 148 of layer 22 that defines the marginal edge of each pad 27 is supported on boundary wall 147. The portion 151 of layer 22 that defines the central part of each pad 27 extends over the top of cavity 141 and contains the array 23 of apertures 26.

The size of apertures 26 in the arrangement of FIGS. 6 and 7 can be the same as the size of apertures 26 in the arrangement of FIGS. 1–4, and similar self-alignment techniques can be used to obtain an initial alignment for forming microtips 14 in general concentric alignment within apertures 26. Beyond this, however, the removal of dielectric 125 from below the apertures 26 is increased compared to that used to obtain the discrete, one-tip-each prior art cavities 41. The traditional size of the cavities 41 is expanded (as indicated by the overlapping dot-dashed etching lines 152 in FIGS. 10A, 10B and 11B), undercutting the gate 22 radially of the apertures 26 to the point where the expanding etched region diameters overlap and the partitions 43 are eliminated at least partially, and preferably completely.

Figure 8A:
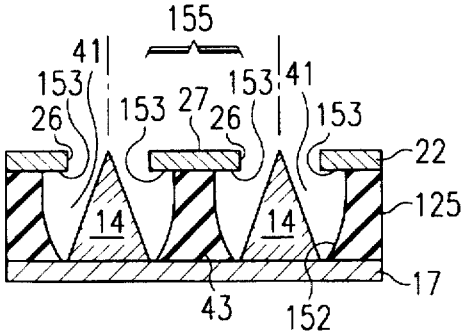
Figure 8B:
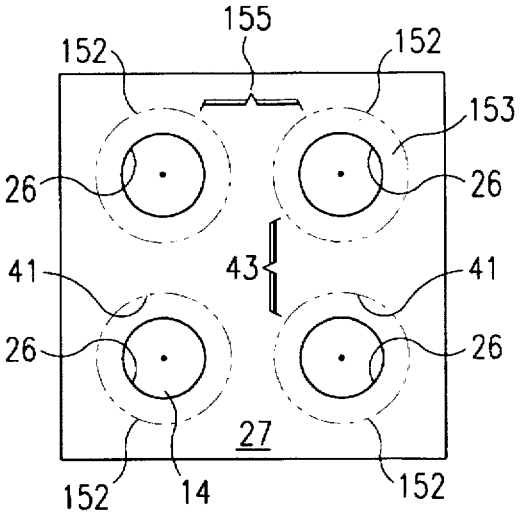
Figure 9A:
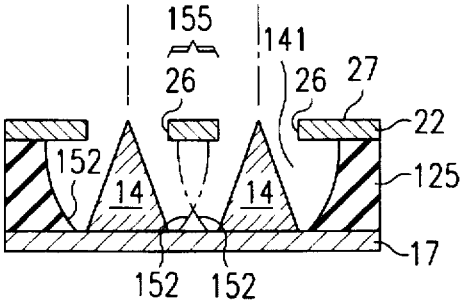
Figure 9B:
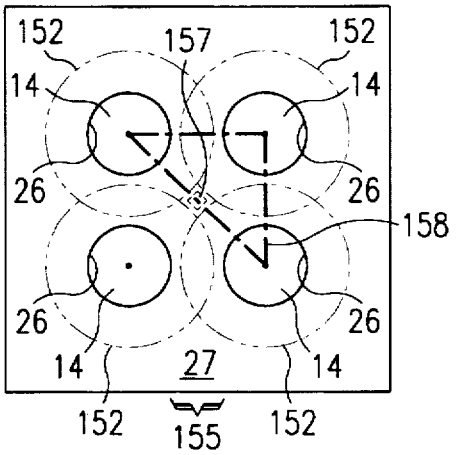

FIGS. 8A–8B, 9A–9B and 10A–10B contrast the packing and undercut etching of traditional microtip and aperture arrays 12, 23, with those of the close-packed arrays of the invention. FIGS. 8A and 8B illustrate spacings of microtips 14 and apertures 26 in rectangular matrix microtip and aperture arrays 12, 23 of the type shown in the Meyer '780 patent. The apertures 26 and microtips 14 are arranged in rectangular matrix arrays having center-to-center spacings between row-adjacent and column-adjacent apertures\tips of about 3.0 microns. Aperture diameters are about 1.3 microns, with only minor undercutting done below gate 22 (at 153) to assist separation of a lift-off layer, thereby leaving walls 43 having a lateral thickness and intermediate gate area 155 having a lateral width of about 1.7 microns between distinct cavities 41 (see also FIGS. 1 and 4). As shown in FIGS. 9A and 9B, the spacing between apertures 26 and microtips 14 in the arrays 12, 23 can be reduced and the undercut 153 increased to the point of overlap. Walls 43 between row-adjacent or column-adjacent microtips 14 are etched away, leaving portions 157 of layer 125 between diagonally-adjacent microtips, where the etch-expanded diameters 152 of former cavities 41 are not overlapped. Cavities 41 are no longer distinct, but are now merged into a larger cavity 141. (Such arrangement is more fully described in U.S. patent application Ser. No. 08/453,593 of Levine et al., entitled "Field Emission Device With Over-Etched Gate Dielectric," filed on even date herewith.) The center-to-center spacing can be reduced for the arrays of FIGS. 9A and 9B to around 2.0 microns, with the lateral width of intermediate gate area 155 (formerly positioned atop a wall 43) reduced by 1.0 microns to about 0.7 microns. This arrangement is still within the optical capabilities of the photolithography equipment currently used to form the 1.3 micron apertures 26, and leaves enough gate material 22 to control the extraction of electrons from the tips 14.

Figure 10A:
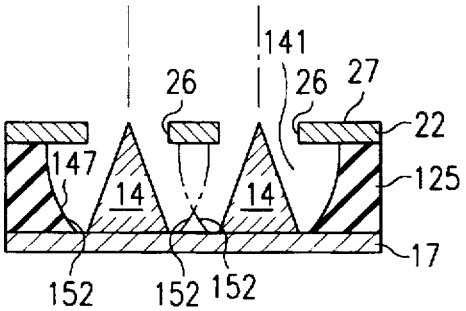
Figure 10B:
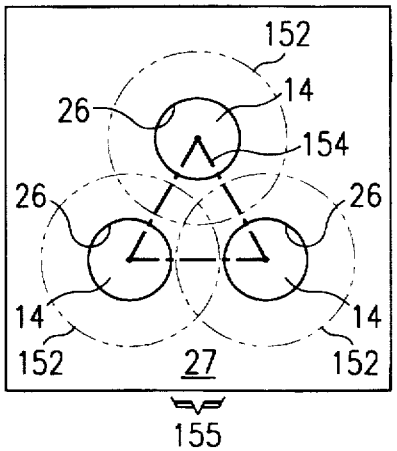

FIGS. 10A and 10B illustrate the inventive arrangement, wherein the reduced dimensions of FIGS. 9A and 9B are implemented in a hexagonal close-packed array. All neighboring apertures are separated by about 2.0 micron spacing, and lines joining centers of adjacent apertures form equilateral triangles 154. The hexagonal close packed structure is especially advantageous for ready removal of all separating walls 43 between neighboring microtips 14. An isosceles right triangle 158 drawn between the centers of three nearest microtips 14 in FIG. 9B contains 0.5 microtips and has a side of 2.0 microns giving an area of 2.0 square microns. The arrangement in FIG. 10B, on the other hand, has an equilateral triangle 154 with 0.5 microtips and a side of 2.0 microns, giving an area of 1.73 microns. For arrays 12 of multiple microtips 14, therefore, the number of microtips 14 per unit area of gate 22 will be greater for the close-packing arrangement of FIGS. 10A and 10B.

Capacitance of the cathode plate structure 10 or 110 is proportional to the area and spacing of the separated conductive layers 18, 22 and to the magnitude of the dielectric constant of the material (viz. insulating layer 25 or 125) separating layers 18, 22. An electron emitting structure in accordance with the invention, as illustrated by the described cathode plate 110, has overall increased brightness due to the greater number of microtip emitters located in the same area because of the close packing. The plate 110 also has overall reduced capacitance because of reduced average dielectric constant resulting from elimination of insulating layer material (compare layer 125 with layer 25) and replacement of the same with the significantly lower dielectric constant of air (viz. vacuum), especially in the vicinity of highest electron concentration (viz. the microtip arrays 12, centrally of the mesh spacings 16). Accordingly, an image display device incorporating the principles of the invention exhibits a lower RC time constant and reduced $\frac{1}{2}CV^2$ power dissipation.

Moreover, arranging the microtips on a plate 17 within each mesh spacing 16 places the microtips 14 of the same array 12 at an equal potential with respect to one another, thereby providing a breakdown resistance ballast having the advantages of lateral resistance, as in the Meyer '780 patent, but without lack of uniformity of resistive paths between the mesh structure and the separate microtip locations.

A conventional process for fabrication of thin-film microtip emission cathode structures of the type described with reference to FIGS. 1–5 is generally described in Spindt U.S. Pat. No. 3,755,704 and Meyer U.S. Pat. No. 5,194,780. Such process can be modified in accordance with illustrative embodiments of methods of the invention to fabricate the structures in accordance with the invention.

Figure 11A:
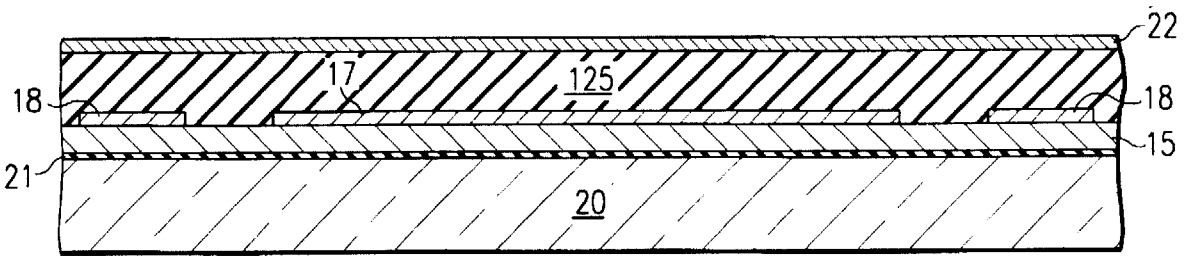

As shown in FIG. 11A (corresponding to the section view of FIG. 7), a resistive layer 15, cathode mesh structure 18, insulating layer 125 and gate electrode layer 22 are successively formed on an upper surface of a glass substrate 20, which has been previously overlaid with a thin layer 21 of silicon dioxide ($SiO_2$) of about 500–1000 Å thickness. Resistive layer 15 may, for example, be formed as a resistive, undoped silicon coating of, e.g., 10,000–12,000 Å thickness, deposited by cathode sputtering or chemical vapor deposition over the silicon dioxide layer 21. The cathode structure 18 may, for example, be formed by depositing a thin coating of conductive material, such as niobium of about 2,000 Å thickness, over the resistive layer. The mesh pattern of structure 18 and connectors defining the columns 19 may then be produced in the conductive coating by photolithography and etching to give, e.g., mesh-defining strips of 2–3 micron widths, providing 25–30 micron generally square mesh spacings 16, at 11×10 mesh spacings per 300 micron pixel, with column-to-column separations of 50 microns (see FIG. 5). A plate 17 is formed centrally of each mesh spacing 16, during patterning of the mesh structure 18. Spacer layer 125 may, for example, be formed as a silicon dioxide ($SiO_2$) layer of 1.0–1.2 micron thickness deposited by chemical vapor deposition over the patterned mesh structure 18, plate 17 and the resistive coating 15 left exposed within the mesh spacings 16. Gate electrode layer 22 may, for example, be formed by depositing a thin metal coating of niobium with, e.g., 2,000 Å thickness over the spacer layer 125. The thicknesses and manners of deposition of the various layers above and below are given for illustrative purposes only, and not by way of limitation.

Figure 11B:
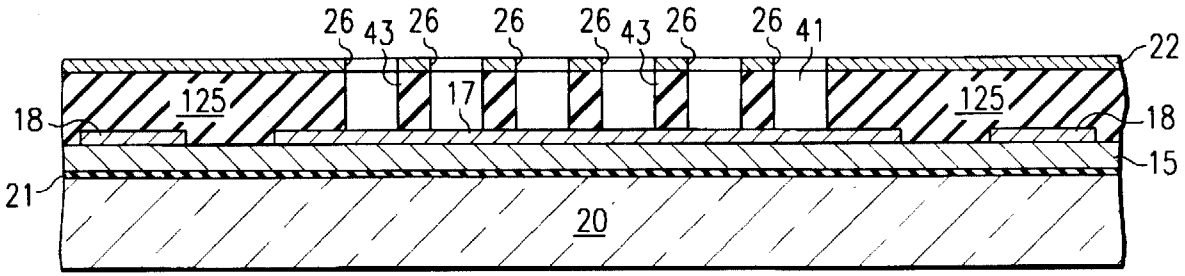
Figure 11C:
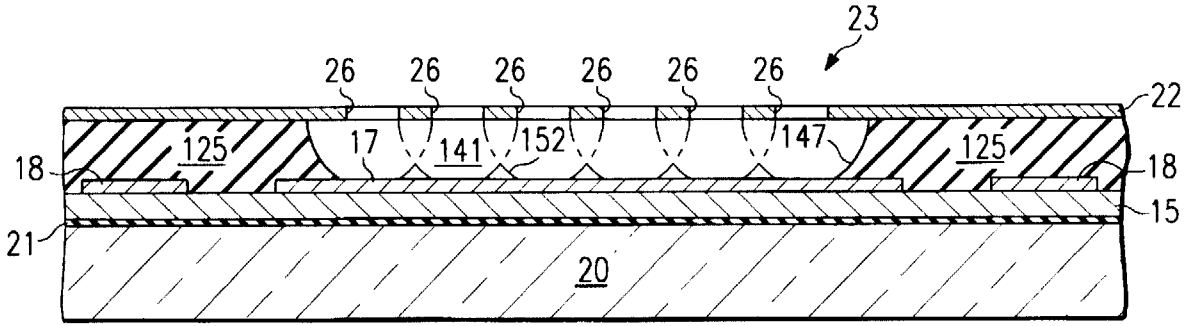

Next, as shown in FIG. 11B, gate layer 22 is masked and etched to define pluralities of apertures 26 of 1.0–1.4 micron diameters arranged in hexagonal close-packed arrays at, for example, 25 micron array pitches. The insulating layer 125 is then subjected first to a first dry etching to form pluralities of arrays of discrete cavities 41 in respective concentric alignments with and located beneath the apertures 26. Layer 125 may then be subjected to a wet etch (see FIG. 11C) to undercut the gate layer away from the apertures 26 to remove the partitions 43 (see FIG. 1) between apertures 26 and form a single common cavity 141, merging the discrete cavities 41 into each other. The bases of partitions 43 can be left, and the wet etching stopped as soon as the tops of the partitions become spaced from the gate layer 22, if desired. Otherwise, as indicated, the etch is continued until the partitions 43 are almost totally eliminated. The etch proceeds generally radially outwardly of the apertures 26.

Figure 11D:
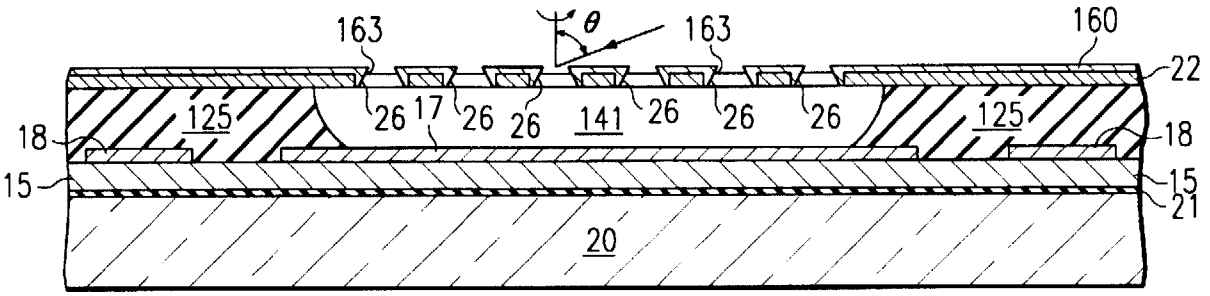
Figure 11E:
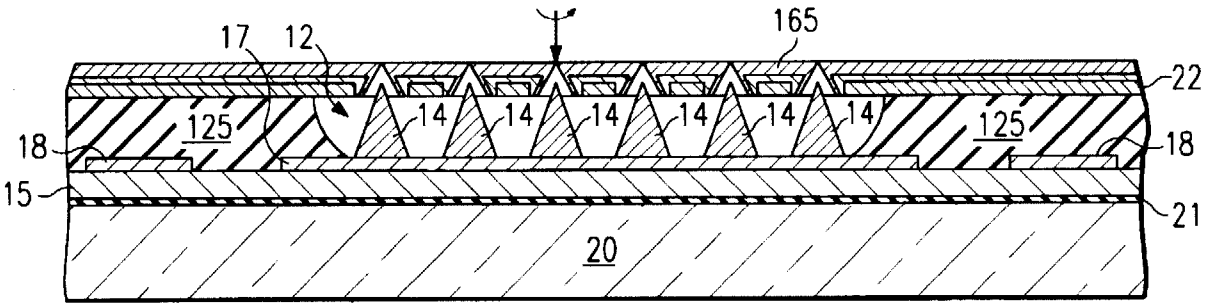
Figure 11F:
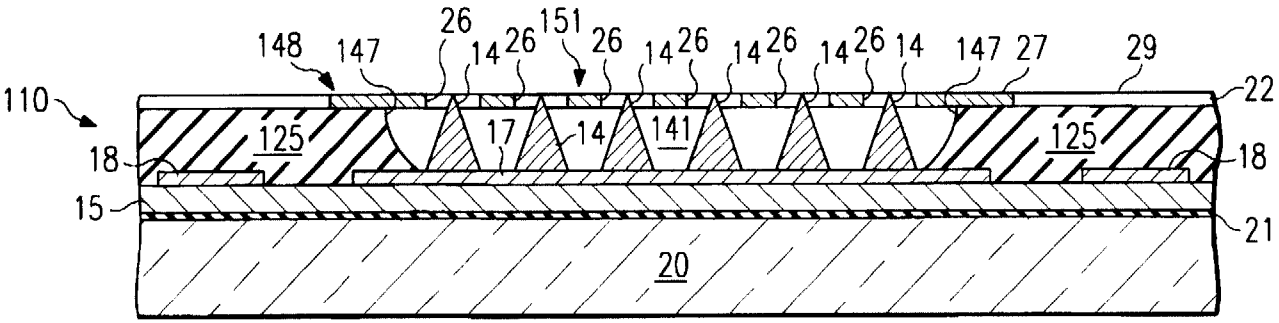

Thereafter, as shown in FIG. 11D, while rotating the substrate 20, a sacrificial lift-off layer 160 of, e.g., nickel is formed by electron beam deposition over the layer 22. The beam is directed at an angle of 5°–20° to the surface (70°–85° from normal) so as to deposit lift-off layer material on the aperture circumferential walls at 163. Then, as shown in FIG. 11E, with substrate 20 again being rotated, molybdenum and/or other conductive tip forming material is deposited on the inner surface of cavity 141 by directing a beam substantially normal to the apertures 26 to form pluralities of arrays of microtips 14, self-aligned in respective concentric alignment within the apertures 26 and cavity 141. Lastly, as shown in FIG. 11F, the superfluous molybdenum deposition 165 deposited over the nickel layer 160 is removed, together with the nickel layer 160. Subsequent masking and etching is used to pattern the apertured layer 22, to define the row cross-stripes 24 (see FIG. 5), the pads 27 and the bridging strips 29 (see FIGS. 3 and 11F). Row cross-stripes 24 may, for example, be formed with widths of 300–400 microns and spacings of 50 microns. Pads 27 may be formed as nominal 15 micron squares centered at 25 micron pitches over mesh spacings 16 and with bridging strips 29 of 2–4 micron widths.

In the illustrated embodiments, the cathode current flows to the microtips 14 through the conductive layer 18 and resistive layer 15. Those skilled in the art to which the invention relates will appreciate that yet other substitutions and modifications can be made to the described embodiments, without departing from the spirit and scope of the invention as defined by the claims below.

What is claimed is:

1. A method of fabricating an electron emitter plate, comprising the steps of:

depositing a first layer of conductive material on a substrate;

depositing a layer of insulating material over said first layer of conductive material;

depositing a second layer of conductive material over said layer of insulating material;

forming a cluster of at least eight apertures in said second layer of conductive material; said apertures extending through said insulating layer and being arranged in a hexagonal close-packed array, wherein lines drawn between centers of each aperture and its closest adjacent apertures form equilateral triangles;

depositing conductive material through said apertures to form a microtip in each aperture in electrical communication with said first layer of conductive material; and etching said layer of insulating material through said apertures to form a cavity connecting said apertures and commonly containing said microtips.

2. The method of claim 1, further comprising a step of patterning said first layer of conductive material to form a mesh structure defining a mesh spacing; said apertures being formed within said mesh spacing.

3. The method of claim 2, further comprising forming a conductive plate within said mesh spacing, laterally spaced from said mesh structure; said microtips being formed over said conductive plate; and depositing a layer of resistive material in contact with said mesh structure and conductive plate.

4. The method of claim 3, wherein said conductive plate is formed from said first layer conductive material in said step of patterning said first layer of conductive material.

5. The method of claim 4, further comprising the steps of patterning said first layer of conductive material to form stripes; and patterning said second layer of conductive material to form cross-stripes which intersect said stripes at pixel-defining locations.

6. The method of claim 2, wherein said second layer of conductive material is further patterned to form a pad located centrally within said mesh spacing and a bridging strip connecting said pad to other parts of said second layer of conductive material; said aperture array being formed on said pad.

7. The method of claim 6, wherein said mesh spacing and pad are formed to be rectangular; and said array of apertures is formed centered on said pad.

8. A method of fabricating an image display device, comprising fabricating an electron emitter plate according to the method of claim 1; forming an anode plate by depositing another layer of conductive material on an anode substrate and depositing cathodoluminescent material on said anode substrate in electrical communication with said another layer of conductive material; and positioning said anode plate spaced across a vacuum gap from said emitter plate.

9. A method of fabricating an electron emitter plate, comprising the steps of:

depositing a first layer of conductive material on a substrate;

patterning said first layer of conductive material in a mesh structure defining a plurality of mesh spacings;

depositing a layer of insulating material over said first layer of conductive material;

depositing a second layer of conductive material over said layer of insulating material;

forming a cluster of apertures in said second layer of conductive material within each mesh spacing; said apertures extending through said insulating layer and said apertures of each cluster all being arranged in a hexagonal close-packed array, wherein lines drawn between centers of each aperture and its closest adjacent apertures form equilateral triangles;

depositing conductive material through said apertures to form a microtip in each aperture in electrical communication with said first layer of conductive material; and etching said layer of insulating material through said apertures to form a cavity within each mesh spacing, each cavity connecting said apertures of one of said clusters and commonly containing said microtips associated with that cluster; said insulating layer supporting said second layer of conductive material above said first layer of conductive material peripherally of each cavity.

10. The method of claim 9, further comprising a step of patterning said second layer of conductive material to form pads respectively located centrally within said mesh spacings; said aperture clusters being respectively formed on said pads.

11. The method of claim 10, further comprising forming a conductive plate located within each mesh spacing, laterally spaced from said mesh structure; said microtips of each cluster being respectively formed over said conductive plates; and depositing a layer of resistive material in contact with said mesh structure and conductive plates.

12. The method of claim 1, wherein said conductive plates are formed from said first layer conductive material in said step of patterning said first layer of conductive material.

13. The method of claim 11, further comprising the steps of patterning said first layer of conductive material to form stripes; and patterning said second layer of conductive material to form cross-stripes which intersect said stripes at pixel-defining locations.

14. The method of claim 9, further comprising patterning said second layer of conductive material to form pads respectively located centrally within said mesh spacings and bridging strips connecting said pads to other parts of said second layer of conductive material; said aperture clusters being respectively formed on said pads.

15. The method of claim 14, wherein said mesh spacings and pads are formed to be rectangular; and said array of apertures is formed centered on said pad.

16. A method of fabricating an image display device, comprising fabricating an electron emitter plate according to the method of claim 9; forming an anode plate by depositing another layer of conductive material on an anode substrate and depositing cathodeluminescent material on said anode substrate in electrical communication with said another layer of conductive material; and positioning said anode plate spaced across a vacuum gap from said emitter plate.

* * * * *